US012486737B2

(12) United States Patent
Vasques

(10) Patent No.: US 12,486,737 B2
(45) Date of Patent: Dec. 2, 2025

(54) ANNULAR BARRIER AND DOWNHOLE SYSTEM

(71) Applicant: Welltec Manufacturing Center Completions ApS, Esbjerg N (DK)

(72) Inventor: Ricardo Reves Vasques, Esbjerg N (DK)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 0 days.

(21) Appl. No.: 18/828,816

(22) Filed: Sep. 9, 2024

(65) Prior Publication Data

US 2025/0084736 A1 Mar. 13, 2025

(30) Foreign Application Priority Data

Sep. 8, 2023 (EP) ..... 23196373
Sep. 11, 2023 (EP) ..... 23196510

(51) Int. Cl.
*E21B 43/10* (2006.01)

(52) U.S. Cl.
CPC ..... *E21B 43/103* (2013.01)

(58) Field of Classification Search
CPC ..... E21B 33/127; E21B 43/103
See application file for complete search history.

(56) References Cited

U.S. PATENT DOCUMENTS 9,518,439 B2 * 12/2016 Hallundbæk ..... E21B 33/122
9,835,023 B2 * 12/2017 Hallundbæk ..... E21B 33/14
10,100,621 B2 * 10/2018 Hallundbæk ..... E21B 43/108
10,180,051 B2 * 1/2019 Vasques ..... E21B 33/126
10,202,819 B2 * 2/2019 Hallundbæk ..... E21B 33/128
10,253,591 B2 * 4/2019 Hazel ..... E21B 33/1212
10,519,741 B2 * 12/2019 Vasques ..... E21B 33/127
10,526,865 B2 * 1/2020 Stæhr ..... E21B 34/063
10,711,562 B2 * 7/2020 Stæhr ..... E21B 33/1208
11,572,758 B2 * 2/2023 Hallundbæk ..... E21B 34/103
12,196,055 B2 * 1/2025 Vasques ..... E21B 33/1277
(Continued)

FOREIGN PATENT DOCUMENTS

EP 2570588 A1 3/2013
WO 2022069547 A1 4/2022

OTHER PUBLICATIONS

Extended European Search Report for EP 23196510, dated Mar. 13, 2024, 6 pages.

*Primary Examiner* — Aaron L Lembo
(74) *Attorney, Agent, or Firm* — Nixon & Vanderhye P.C.

(57) ABSTRACT

An expandable annular barrier has a tubular metal part for mounting as part of the well tubular metal structure, the tubular metal part having a bore with a bore pressure, and an expandable metal sleeve surrounding the tubular metal part. The annular barrier has a pressure-intensifying unit for increasing the pressure of the fluid from the annulus or the bore before the fluid enters an expandable space, and an activation chamber having a chamber pressure and being fluidly connected to an opening of the pressure-intensifying unit in order to create a pressure difference between the annulus pressure/the bore pressure and the chamber pressure for activating the pressure-intensifying unit to increase the pressure of the fluid. The chamber pressure can be higher or lower than the annulus pressure or the bore pressure.

19 Claims, 16 Drawing Sheets

(56) References Cited

U.S. PATENT DOCUMENTS

Figure 1:
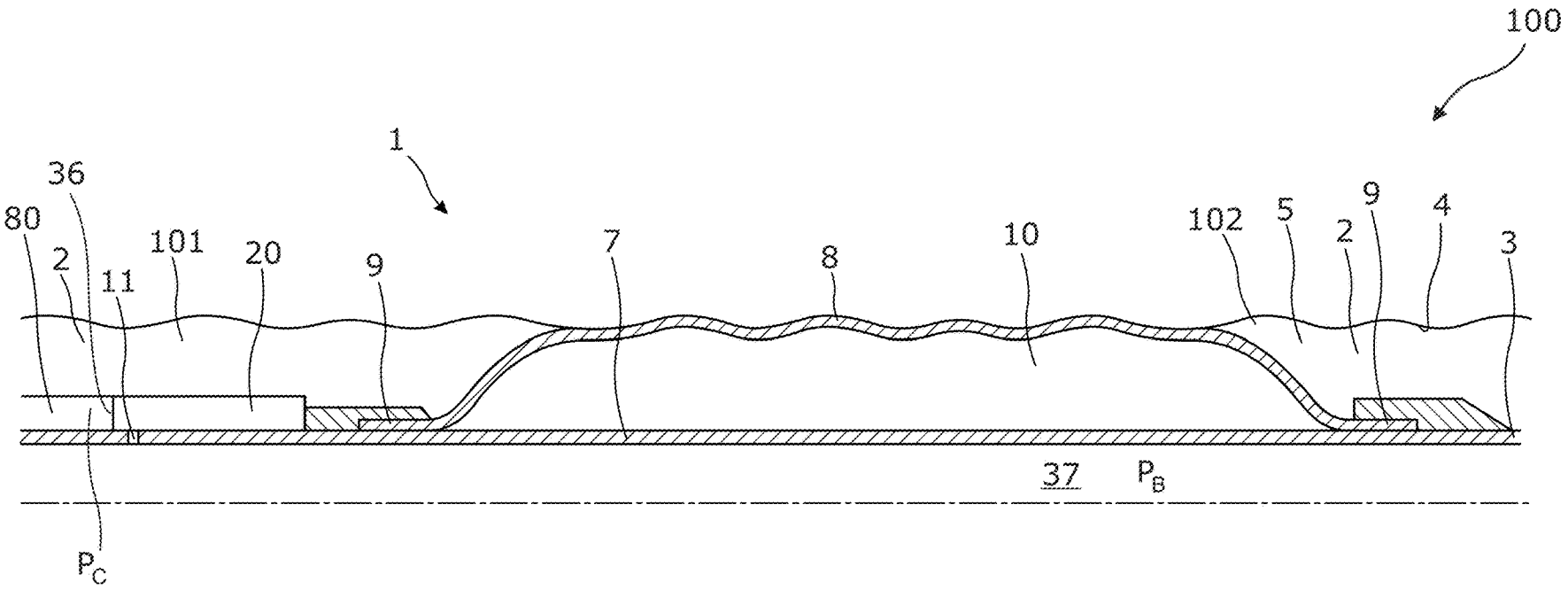

| | | | | |
|---|---|---|---|---|
| 2013/0186615 | A1* | 7/2013 | Hallunbæk | E21B 23/06 166/120 |
| 2014/0190683 | A1* | 7/2014 | Hallunbæk | E21B 34/06 166/381 |
| 2020/0248530 | A1* | 8/2020 | Kumar | E21B 34/10 |
| 2022/0098954 | A1* | 3/2022 | Hallundbæk | E21B 33/12 |
| 2022/0195832 | A1* | 6/2022 | Hallundbæk | E21B 33/127 |

* cited by examiner

ANNULAR BARRIER AND DOWNHOLE SYSTEM

This application claims priority to EP 23196510.4 filed Sep. 11, 2023, and EP 23196373.7 filed Sep. 8, 2023, the entire contents of each of which are hereby incorporated by reference.

The present invention relates to an annular barrier to be expanded in an annulus between a well tubular metal structure and an inside wall of a borehole downhole for providing zone isolation between a first zone and a second zone of the borehole. The invention also relates to downhole system comprising a well tubular metal structure and at least one annular barrier where the tubular metal part is mounted as part of the well tubular metal structure.

Annular barriers are used downhole to isolate around a well tubular metal structure, which means any kind of pipe, tubing, casing, tubular, liner, string, etc., used downhole in relation to oil or natural gas production. Often the well tubular metal structure is pressurised from within to expand the annular barrier; however, when the well tubular metal structure also comprises screens or perforations or similar openings elsewhere, the well tubular metal structure cannot be pressurised to expand the annular barrier. A known way to expand such well tubular metal structures is to run an intervention tool inside the well tubular metal structure and isolate an area around the expansion opening of the annular barrier in order to pressurise this area and expand the annular barrier.

It is an object of the present invention to wholly or partly overcome the above disadvantages and drawbacks of the prior art. More specifically, it is an object to provide an improved annular barrier which is expandable even though the well tubular metal structure has other openings such as screens, perforations, etc.

The above objects, together with numerous other objects, advantages and features, which will become evident from the below description, are accomplished by a solution in accordance with the present invention by an annular barrier to be expanded in an annulus having an annulus pressure between a well tubular metal structure and an inside wall of a borehole downhole for providing zone isolation between a first zone and a second zone of the borehole, comprising

- a tubular metal part for mounting as part of the well tubular metal structure, the tubular metal part having a bore with a bore pressure,
- an expandable metal sleeve surrounding the tubular metal part, each end of the expandable metal sleeve being connected with the tubular metal part, and
- an expandable space between the expandable metal sleeve and the tubular metal part,
- wherein the annular barrier further comprises a pressure-intensifying unit having a first opening in fluid communication with the annulus or the bore for increasing the pressure of the fluid from the annulus before the fluid enters the expandable space, the annular barrier further comprising an activation chamber having a chamber pressure and being fluidly connected to a second opening of the pressure-intensifying unit in order to create a pressure difference between the annulus pressure/the bore pressure and the chamber pressure for activating the pressure-intensifying unit to increase the pressure of the fluid, the chamber pressure being substantially lower than the annulus pressure or the bore pressure, or the chamber pressure being substantially higher than the annulus pressure or the bore pressure.

Thus, the activation chamber creates a pressure difference to operate the pressure-intensifying unit. The pressure-intensifying unit has a high-pressure side and a low-pressure side in order to function. If the activation chamber is to provide the low pressure for the pressure-intensifying unit to function, the activation chamber is connected to the low-pressure side of the pressure-intensifying unit, and if the activation chamber is to provide the high pressure for the pressure-intensifying unit to function, the activation chamber is connected to the high-pressure side of the pressure-intensifying unit. Thus, the annular barrier can be expanded independently on the annulus pressure, and if the well tubular metal structure is perforated. The annular barrier is thus automatically expanded, meaning that no additional pressure force than the bore pressure has to be applied, which is not possible in well tubular metal structures having screens, perforations or similar openings. By having the activation chamber with lower pressure or higher pressure than the annulus pressure/bore pressure connected to the pressure-intensifying unit 20, the annular barrier can be expanded even though the well tubular metal structure has other openings such as screens, perforations, etc., and without having an opening in the tubular metal part which needs to close after the expansion.

Also, the pressure-intensifying unit may have a first bore and a piston unit, the first bore having a first bore part with a first inner diameter and having a first bore end part and a second bore part with a second inner diameter and having a second bore end part, the piston unit having a first piston with a first outer diameter corresponding to the first inner diameter and a second piston with a second outer diameter corresponding to the second inner diameter, and the second piston being connected to the first piston by means of a connecting rod, which connecting rod has a smaller outer diameter than the second piston, the first outer diameter being smaller than the second outer diameter, the first bore part having the first opening and the second bore part having the second opening.

Moreover, the piston unit may move between a first position in which the first piston is closer to the first bore end part than the second bore part and a second position in which the first piston is closer to the second bore part than the first bore end part.

Furthermore, the first opening may be in fluid communication with the annulus through a first fluid channel, a first non-return valve being arranged in the first fluid channel allowing fluid to enter the first opening.

In addition, the first opening may be in fluid communication with the bore through a first fluid channel, a first non-return valve being arranged in the first fluid channel allowing fluid to enter the first opening.

Further, the second bore part may have the second opening closer to the first bore part than the second bore end part.

Also, the first bore part may have a third opening in fluid communication with the expandable space through a second non-return valve.

Moreover, the second bore part may have a fourth opening for the entry of fluid in order to allow the first piston to move in a first direction, ejecting fluid through the third opening and into the expandable space, and for the exit of fluid in order to allow the first piston to move in a second direction opposite the first direction.

Further, the pressure intensifier may further comprise a sequence piston having a first sequence position in which the sequence piston allows fluid communication between the second opening and the fourth opening and a second sequence position in which the sequence piston allows fluid communication between the second opening and the fourth opening in order to move the piston unit in the first direction.

Also, the pressure-intensifying unit may have a first bore and a piston unit, the first bore having a first bore part with a first inner diameter and a first bore end part, and a second bore part with a second inner diameter and a second bore end part, the piston unit having a first piston with a first outer diameter corresponding to the first inner diameter and a second piston with a second outer diameter corresponding to the second inner diameter, and the second piston being connected to the first piston by means of a connecting rod, which connecting rod has a smaller outer diameter than the second piston, the first outer diameter being smaller than the second outer diameter; the piston unit moves between a first position in which the first piston is closer to the first bore end part than the second bore part and a second position in which the first piston is closer to the second bore part than the first bore end part, the first bore part having a first opening in fluid communication with an expansion opening through a first fluid channel, a first non-return valve being arranged in the first fluid channel allowing fluid to enter the first opening, the second bore part having the second opening closer to the first bore part than the second bore end part, the first bore part having a third opening in fluid communication with the expandable space through a second non-return valve, the second bore part having a fourth opening for entry of fluid in order to allow the first piston to move in a first direction, ejecting fluid through the third opening and into the expandable space, and for exit of fluid in order to allow the first piston to move in a second direction opposite the first direction, and a sequence piston having a first sequence position in which the sequence piston allows fluid communication between the second opening and the fourth opening, and a second sequence position in which the sequence piston allows fluid communication between the second opening and the fourth opening in order to move the piston unit in the first direction.

Furthermore, in the first position most of the fluid in the first bore part in front of the first piston may have entered the expandable space, and in the second position the first bore part may be filled with fluid in front of the first piston.

In addition, the activation chamber may be filled with pressurised nitrogen or similar gas.

Further, the activation chamber pressurised with nitrogen may have a substantially higher pressure than that of the bore pressure or the annulus pressure.

Also, the activation chamber pressurised with nitrogen may have a substantially larger volume than needed to expand the expandable metal sleeve.

Moreover, a shear element valve block may be fluidly connecting and disconnecting the pressure-intensifying unit with the expandable space.

In addition, the activation chamber may be a low-pressure chamber.

Further, the activation chamber may be a high-pressure chamber, i.e. the chamber pressure may be substantially higher than the bore pressure or the annulus pressure.

Further, the activation chamber may be closed at surface so that the chamber pressure is approximately 1 Atm, such as 101325 Pa, or 1,01325 Bar.

In addition, the activation chamber may comprise a chamber piston dividing the chamber in a first chamber part and a second chamber part, the first chamber part being pressurised at surface, and the second chamber part being in fluid communication with the bore or annulus so that the first chamber part is further pressurised as the annular barrier is run into the well.

Further, the second opening may be blocked by a shear disc or a similar blocking element for closing the activation chamber while the annular barrier is run in hole.

Also, the shear disc may be based on absolute pressure.

Moreover, the fluid communication between the second opening and the annulus or bore may be closed by a mechanical connection, such as a sleeve or a valve 35 assembly having a breakable pin, the mechanical connection being activated to open by means of a timer or a tool run into the well tubular metal structure.

Moreover, the second opening may be blocked by a mechanical connection for closing the activation chamber while the annular barrier is run in hole.

In addition, the mechanical connection may be activated to open by means of a tool run into the well tubular metal structure.

Further, the chamber pressure may be least 5 times lower than the annulus pressure or the bore pressure, preferably at least 8 times lower than the annulus pressure or the bore pressure, and more preferably at least 10 times lower than the annulus pressure or the bore pressure.

Also, the chamber pressure may be at least 5 times higher than the annulus pressure or the bore pressure, preferably at least 8 times higher than the annulus pressure or the bore pressure, and more preferably at least 10 times higher than the annulus pressure or the bore pressure.

Moreover, the activation chamber may have a chamber volume which is at least 5% higher than the expandable space in the expanded condition of the annular barrier.

Finally, the invention also relates to a downhole system comprising a well tubular metal structure and at least one annular barrier, where the tubular metal part is mounted as part of the well tubular metal structure.

Figure 2A:
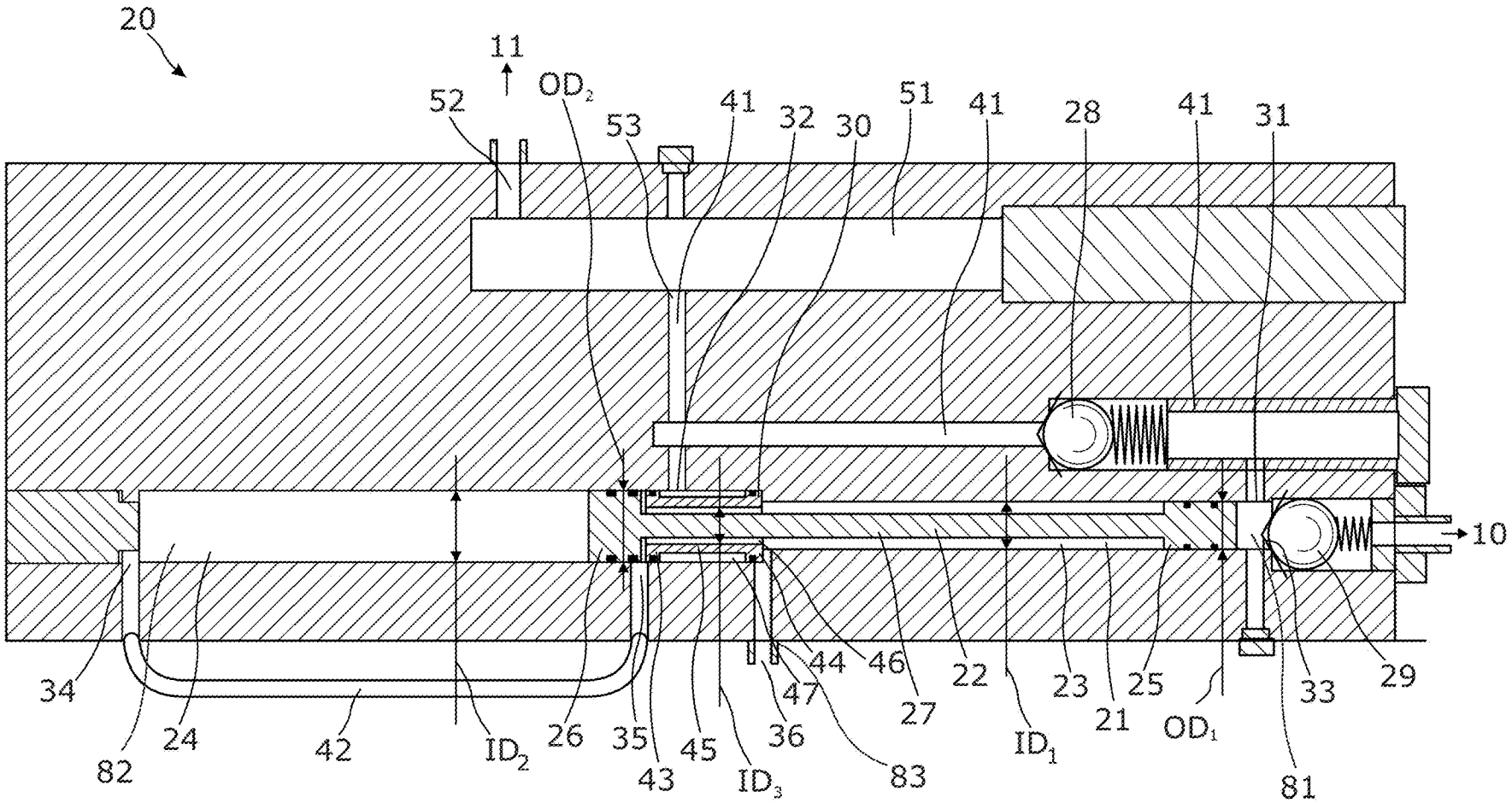
Figure 2B:
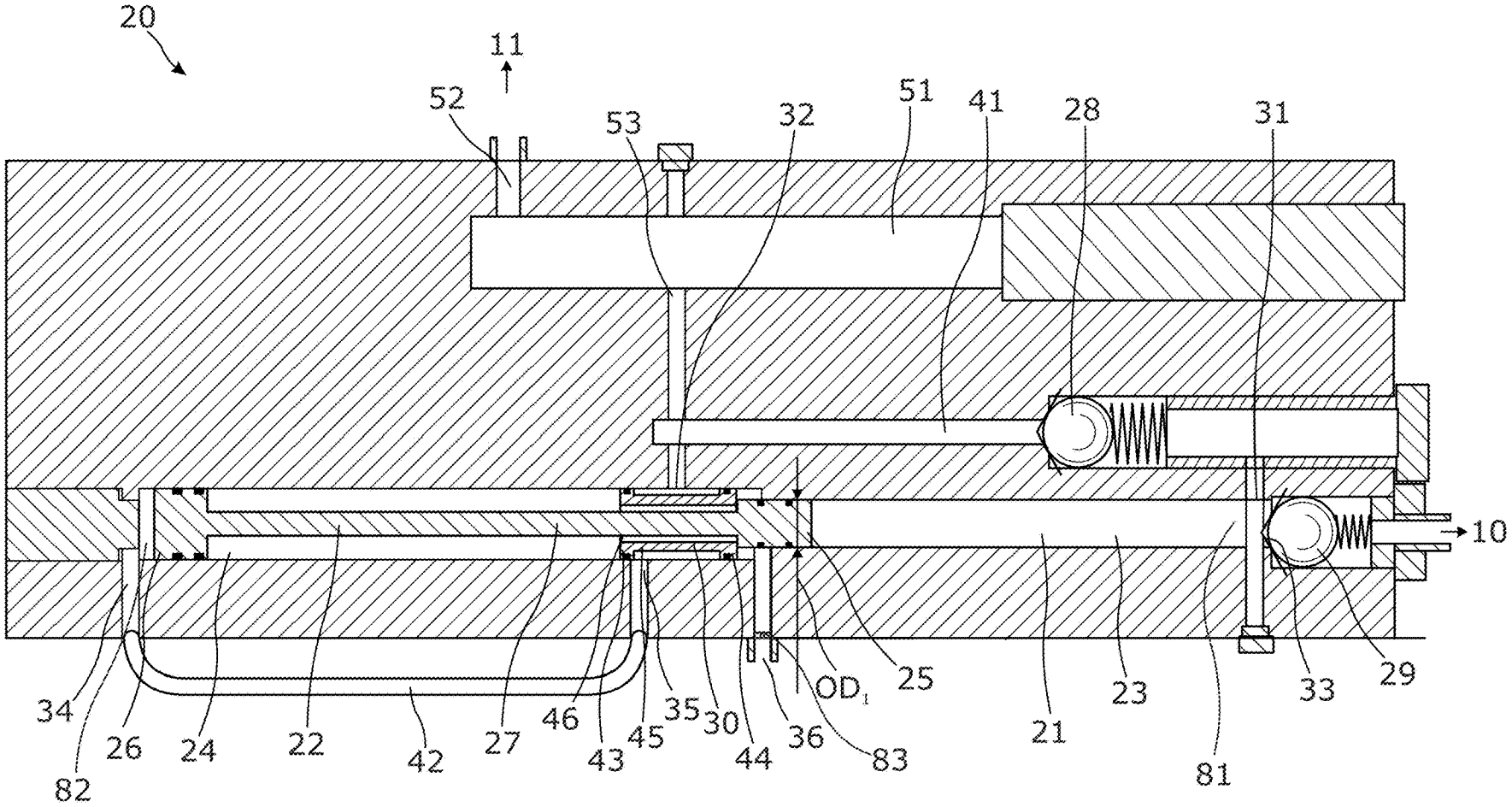
Figure 3:
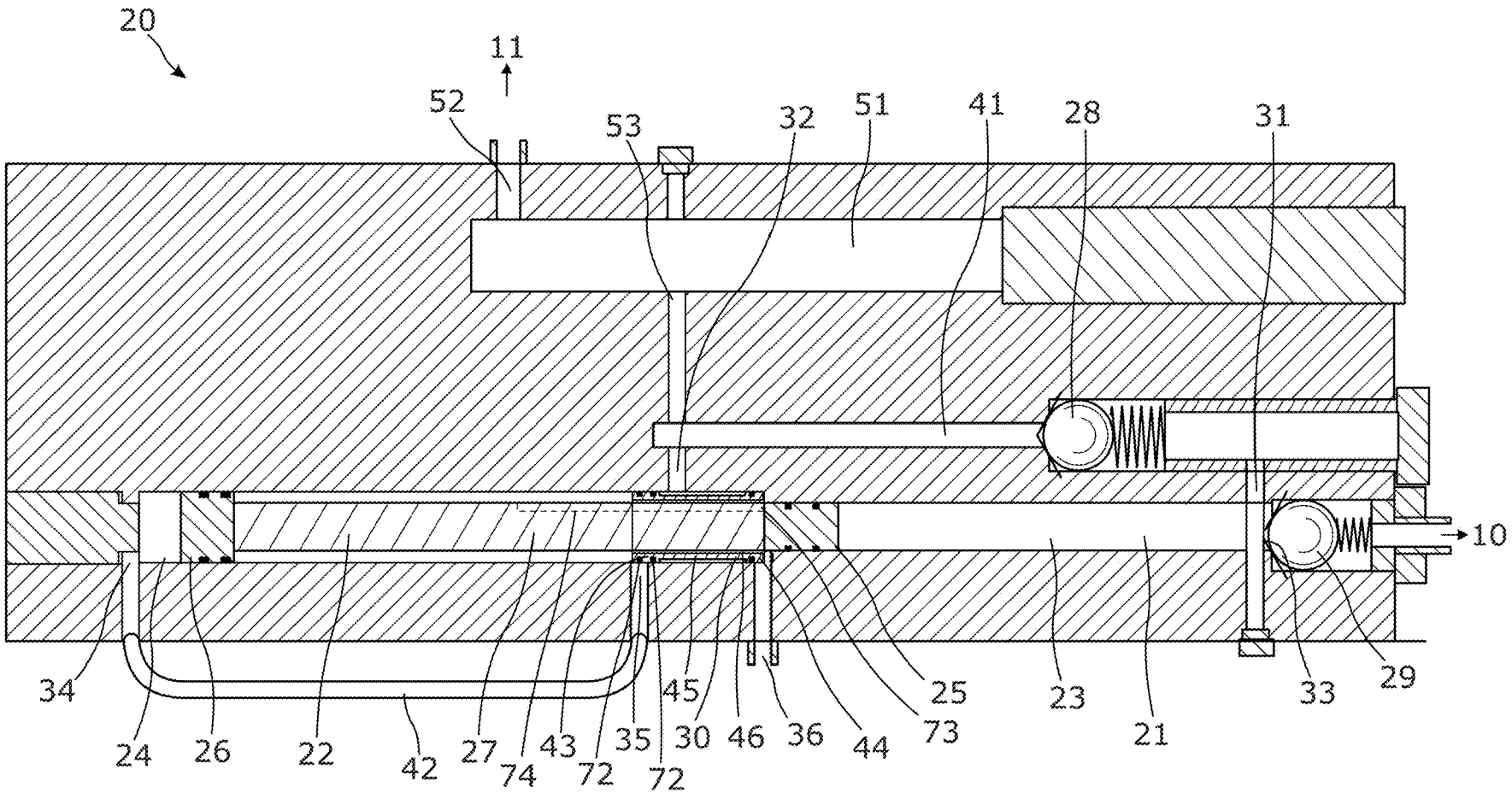
Figure 4A:
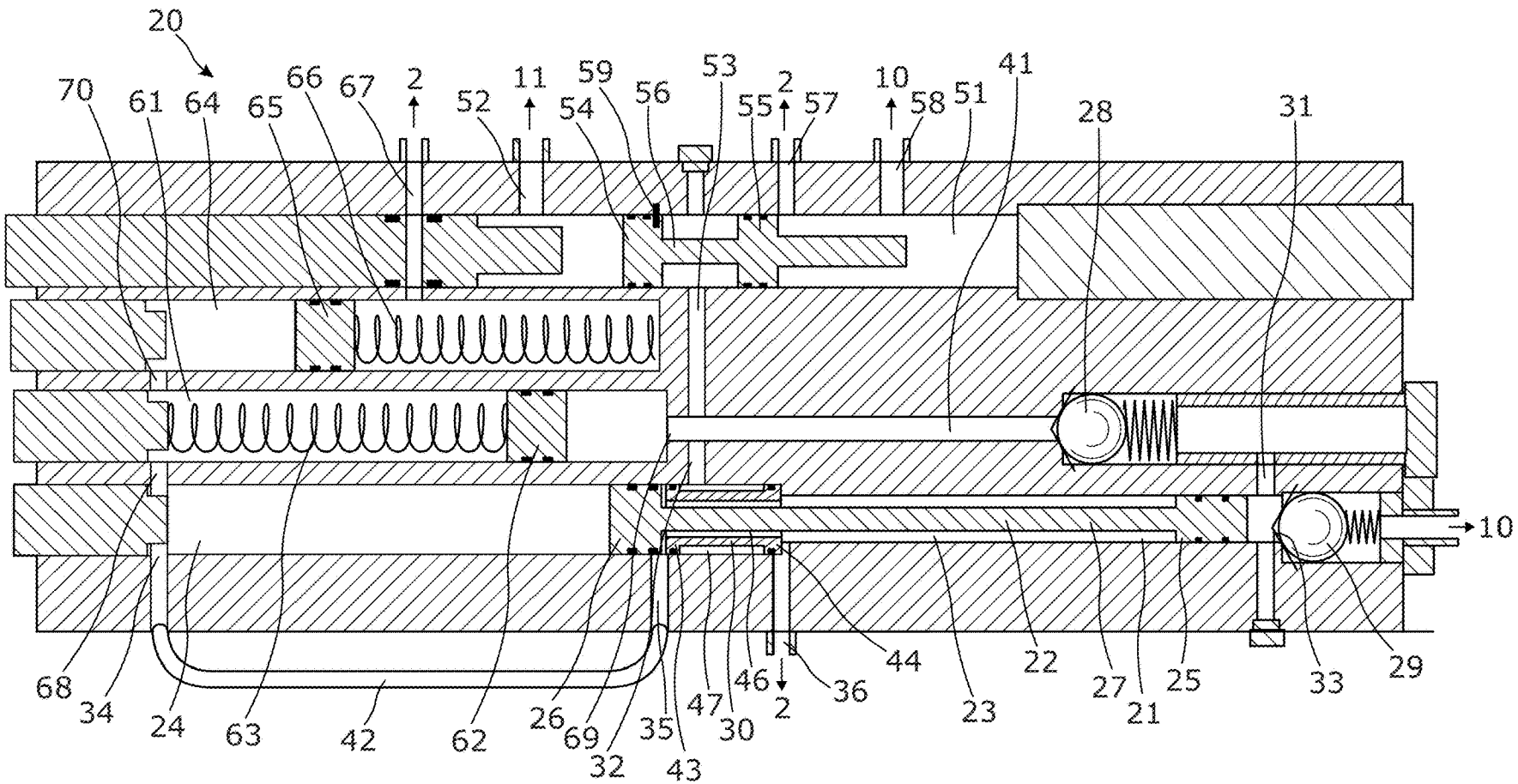
Figure 4B:
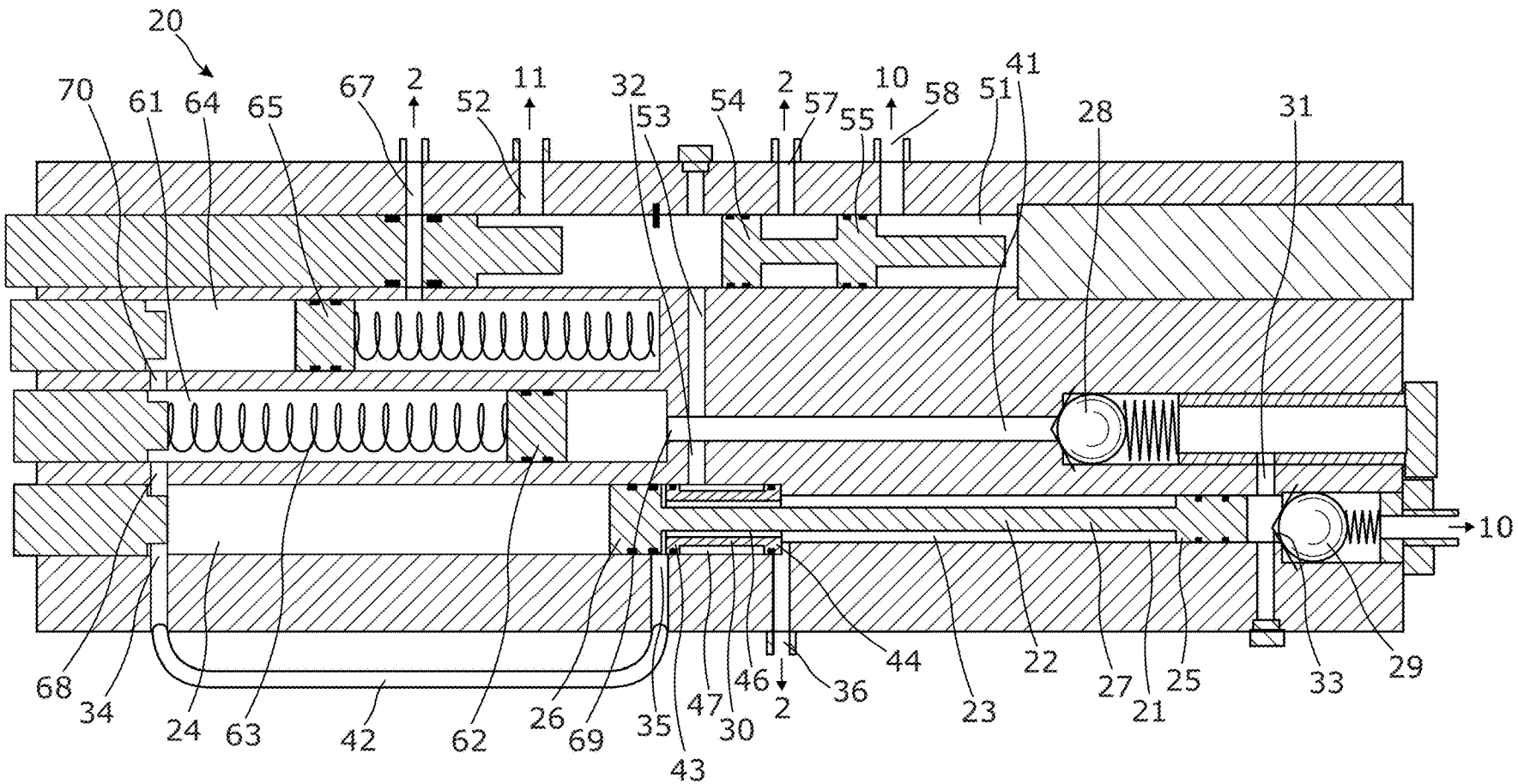
Figure 4C:
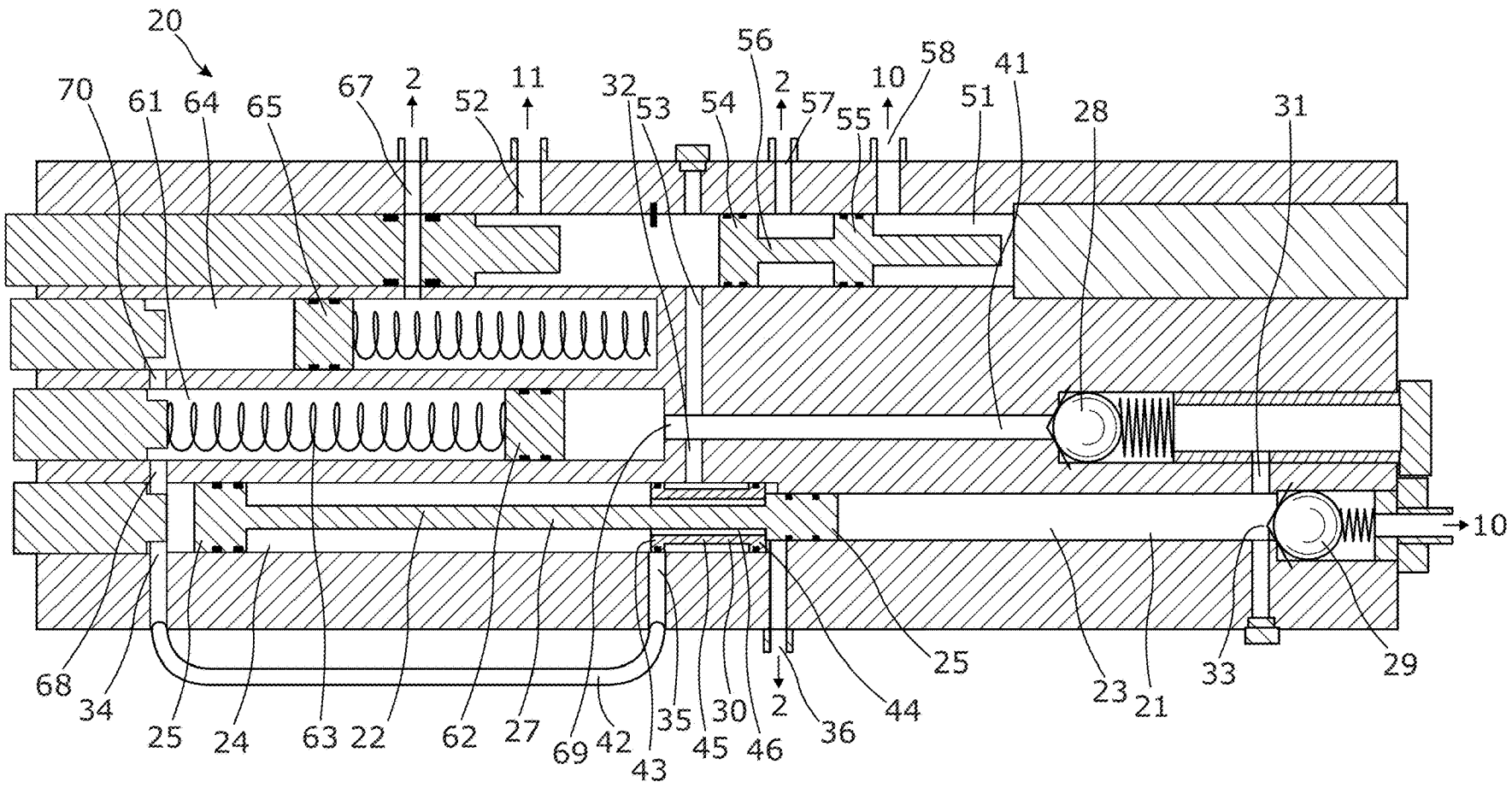
Figure 4D:
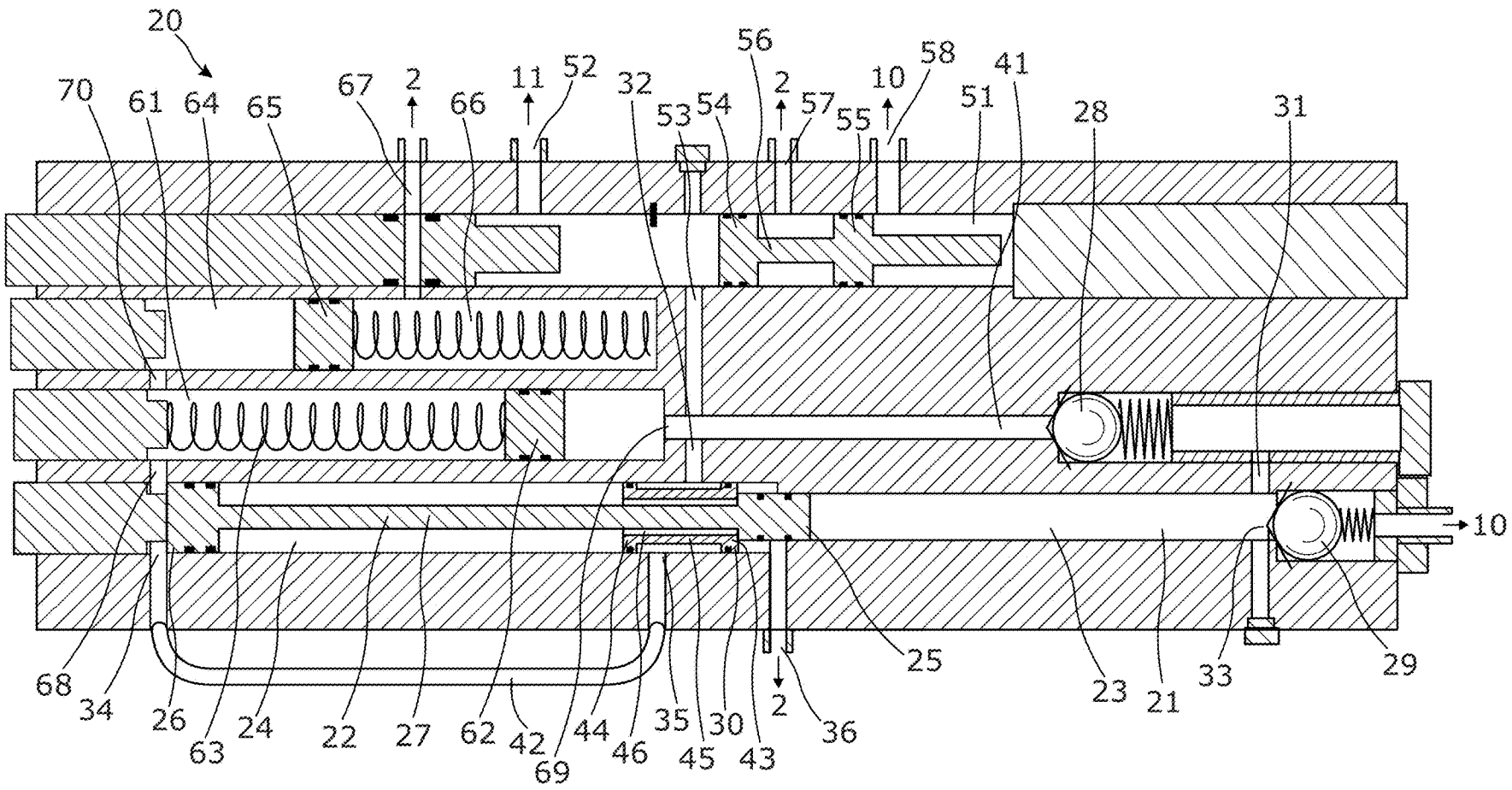
Figure 4E:
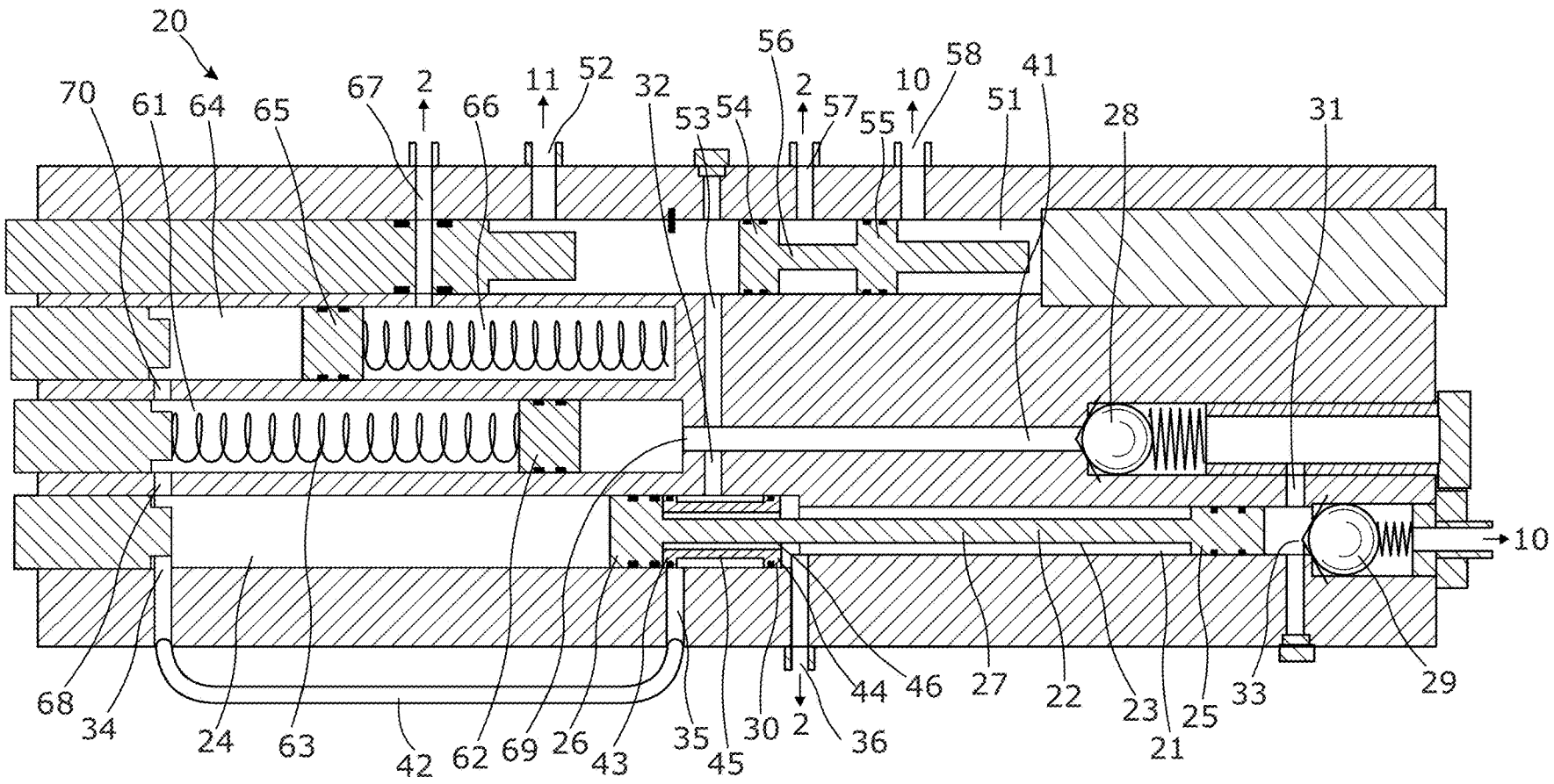
Figure 4F:
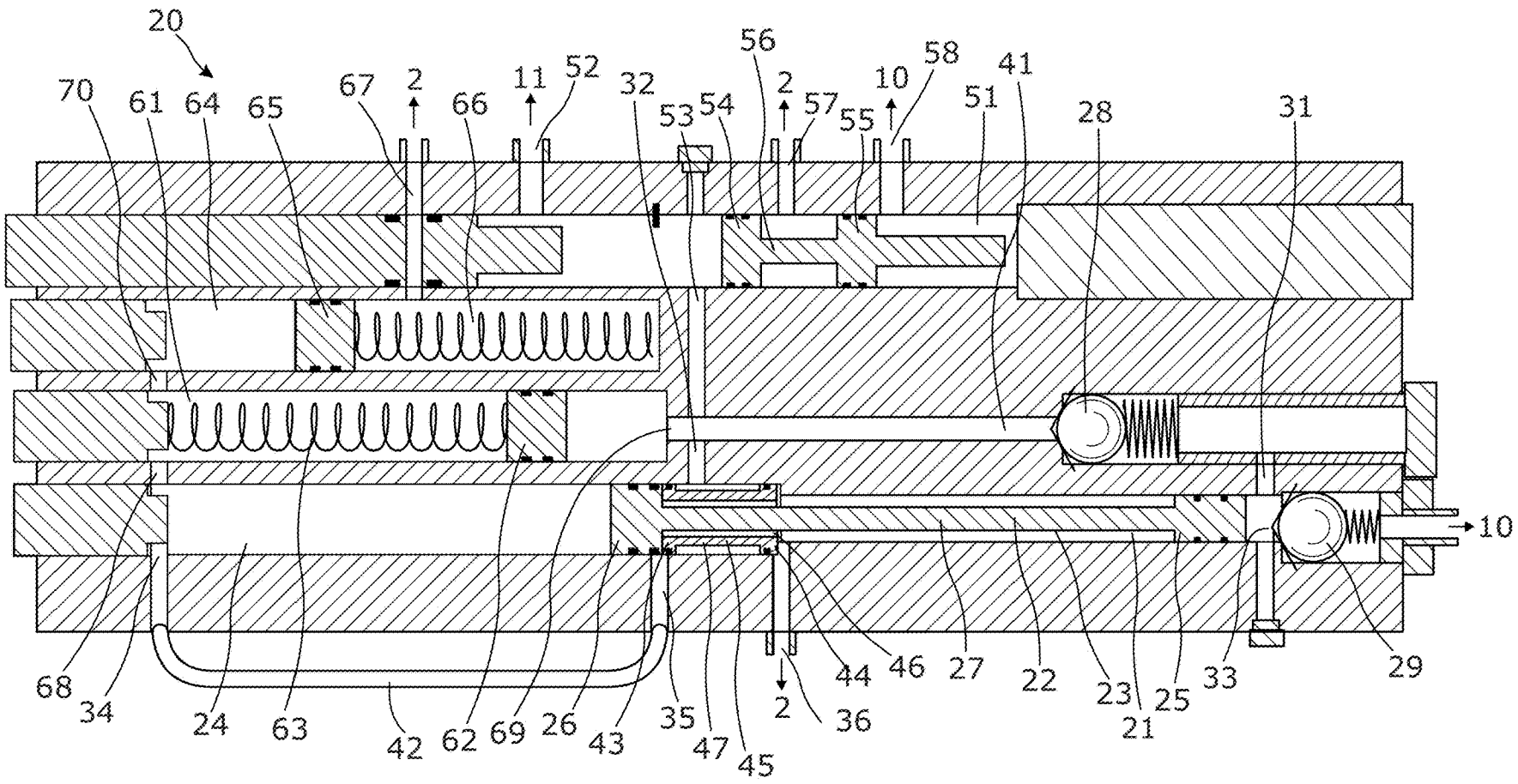
Figure 5A:
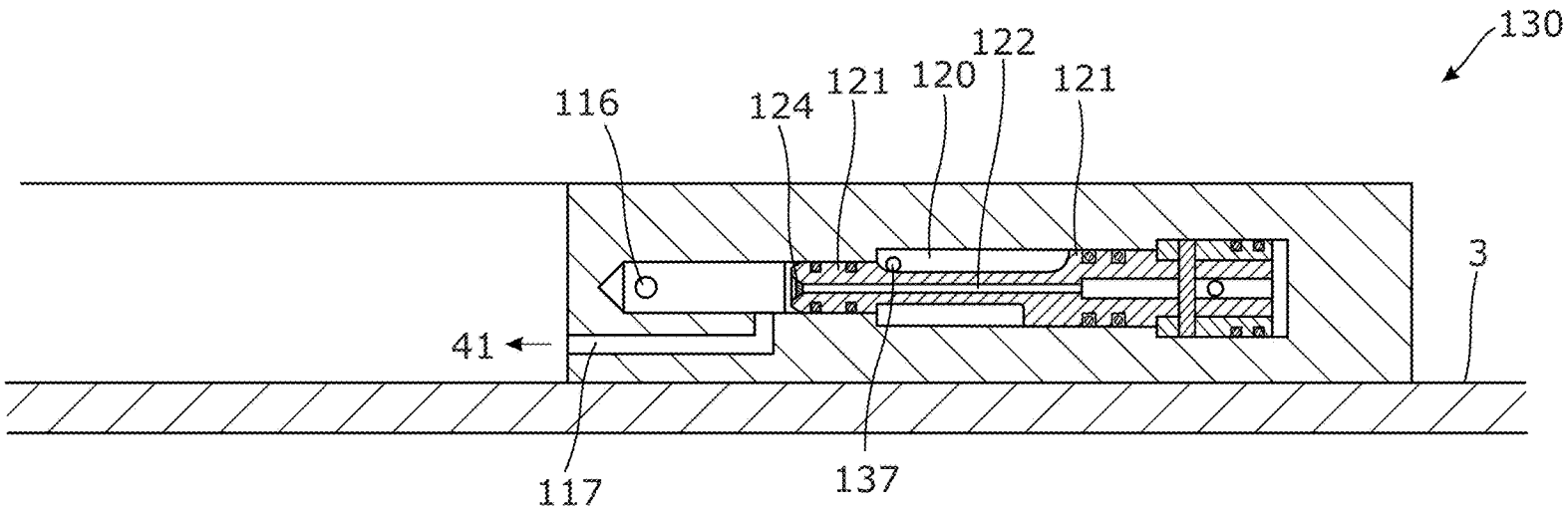
Figure 5B:
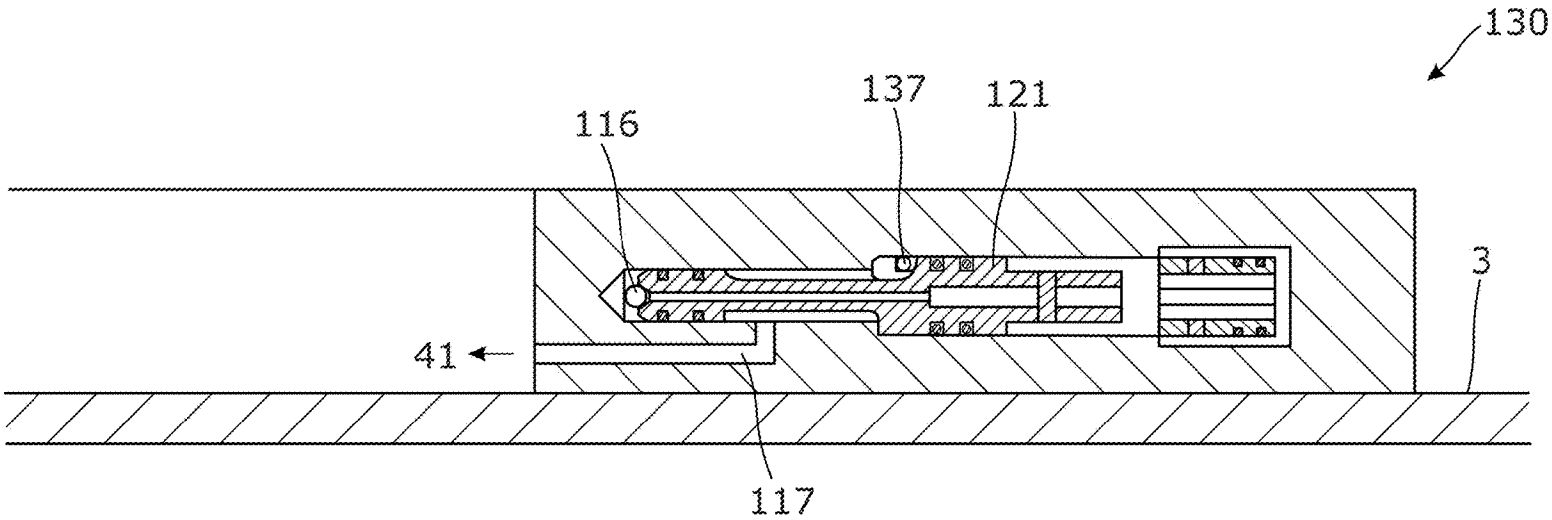
Figure 6:
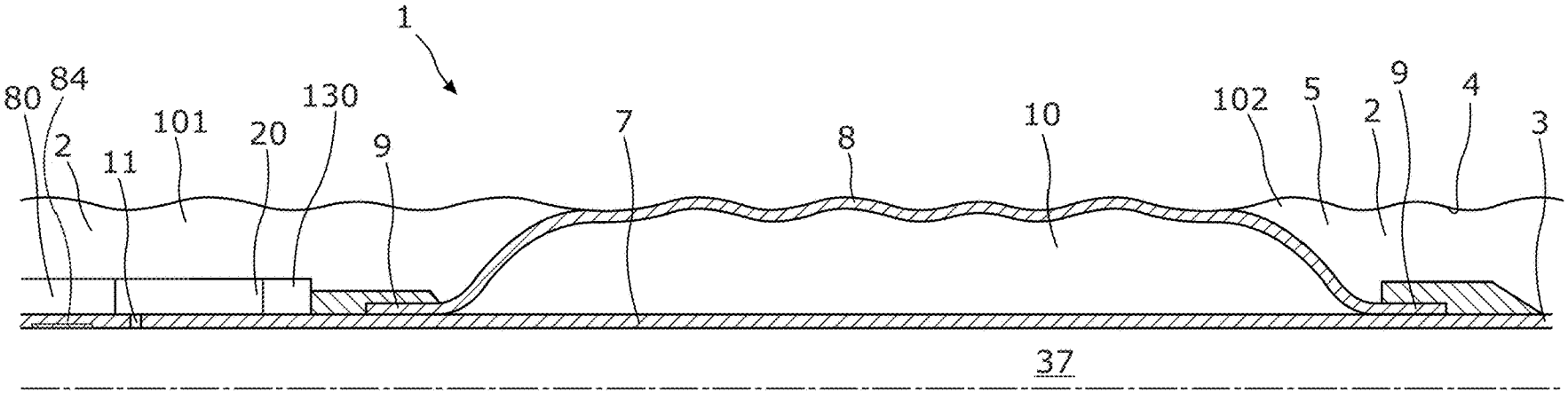
Figure 7A:
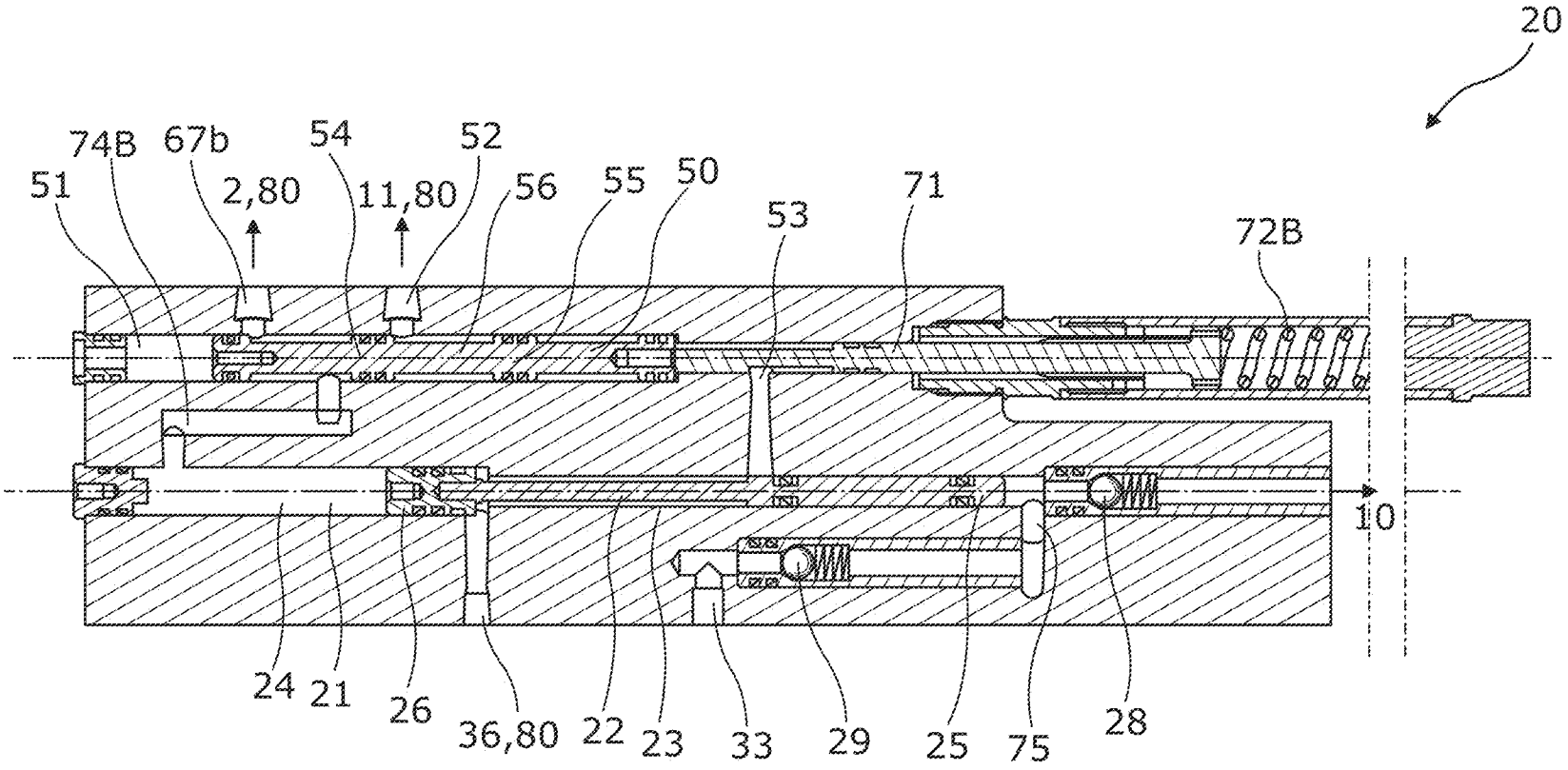
Figure 7B:
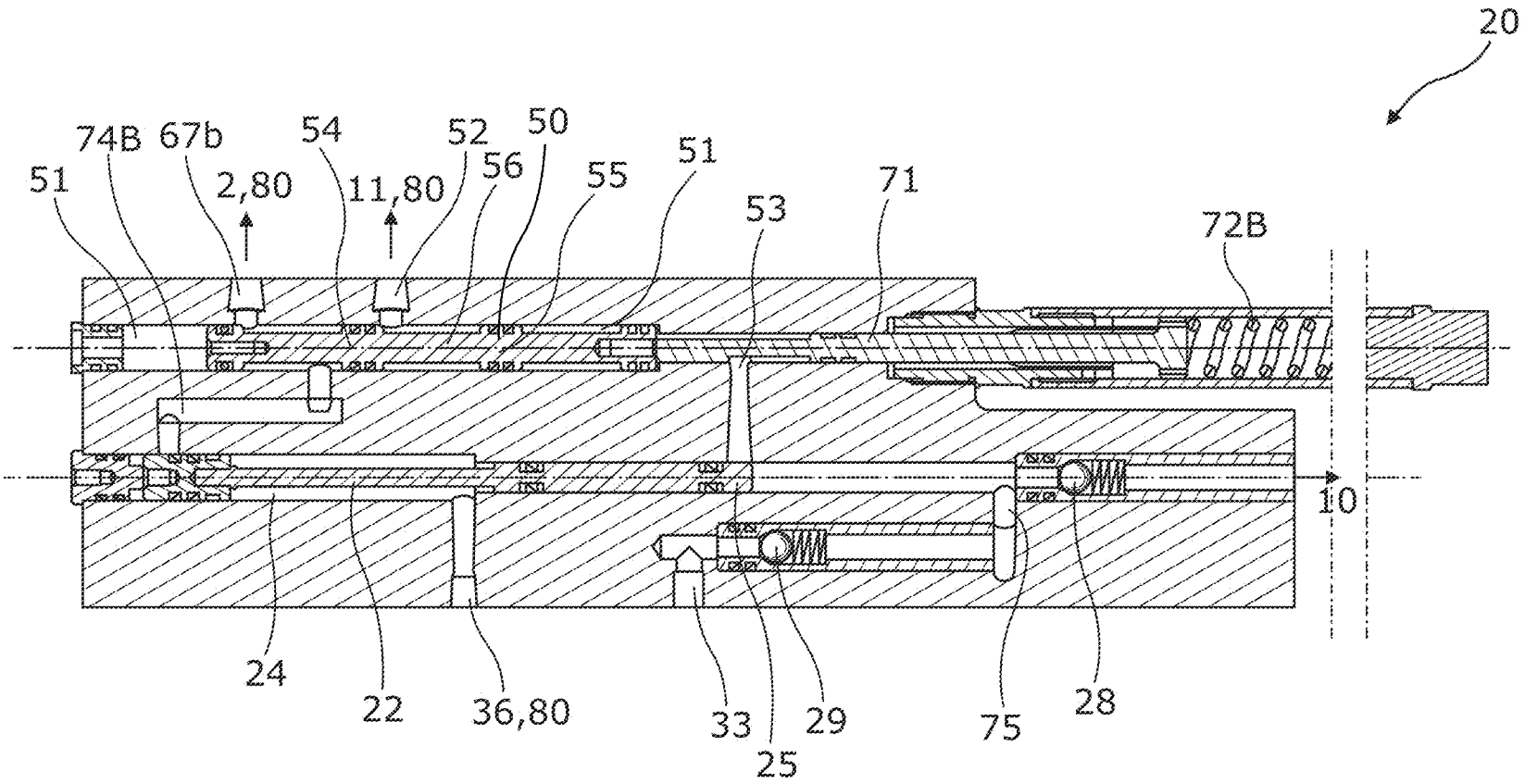
Figure 7C:
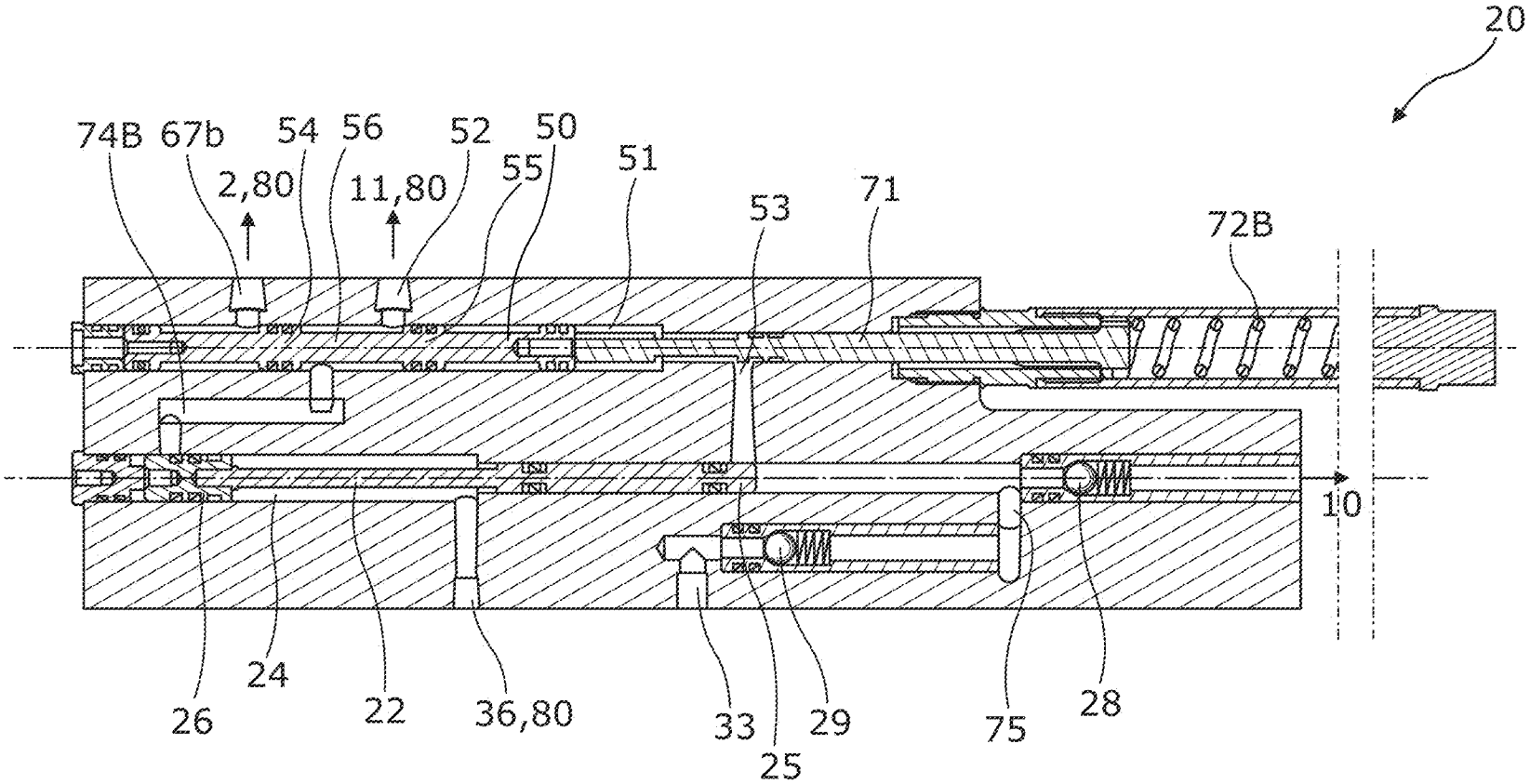
Figure 7D:
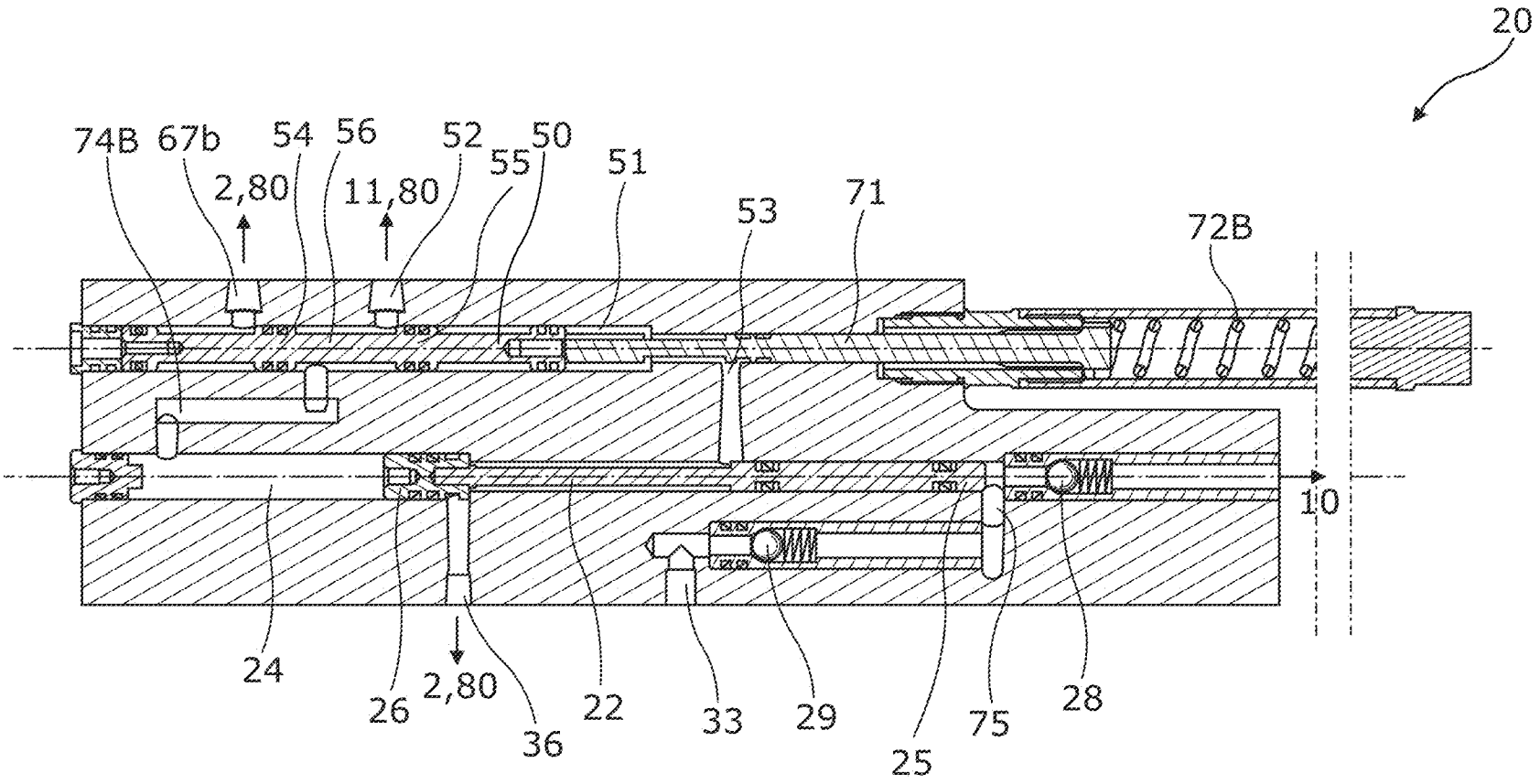

The invention and its many advantages will be described in more detail below with reference to the accompanying schematic drawings, which for the purpose of illustration show some non-limiting embodiments and in which:

FIG. 1 shows a cross-sectional view of an annular barrier according to the invention having a pressure-intensifying unit and a low-pressure or high-pressure activation chamber, FIG. 2A shows a cross-sectional view of a pressure-intensifying unit in one position, FIG. 2B shows a cross-sectional view of a pressure-intensifying unit of FIG. 2A in another position, FIG. 3 shows a cross-sectional view of another pressure-intensifying unit, FIG. 4A shows a cross-sectional view of another pressure-intensifying unit having an accumulating chamber, FIG. 4B shows a cross-sectional view of a pressure-intensifying unit of FIG. 4A in another position, FIG. 4C shows a cross-sectional view of a pressure-intensifying unit of FIG. 4A in yet another position, FIG. 4D shows a cross-sectional view of a pressure-intensifying unit of FIG. 4A in yet another position, FIG. 4E shows a cross-sectional view of a pressure-intensifying unit of FIG. 4A in yet another position, FIG. 4F shows a cross-sectional view of a pressure-intensifying unit of FIG. 4A in yet another position, FIGS. 5A-B show a cross-sectional view of a shear element valve block in an open and closed position, FIG. 6 shows a cross-sectional view of an annular barrier according to the invention having a pressure-intensifying unit, a shear element valve block and a low-pressure chamber, FIG. 7A shows a cross-sectional view of yet another pressure-intensifying unit in a first position, FIG. 7B shows a cross-sectional view of the pressure-intensifying unit of FIG. 7A in second position, FIG. 7C shows a cross-sectional view of the pressure-intensifying unit of FIG. 7A in third position, and FIG. 7D shows a cross-sectional view of the pressure-intensifying unit of FIG. 7A in fourth position.

All the figures are highly schematic and not necessarily to scale, and they show only those parts which are necessary in order to elucidate the invention, other parts being omitted or merely suggested.

FIG. 1 shows an annular barrier 1 which has been expanded in an annulus 2 having an annulus pressure between a well tubular metal structure 3 and an inside wall 4 of a borehole 5 downhole, providing zone isolation between a first zone 101 and a second zone 102 of the borehole 5. The annular barrier 1 comprises a tubular metal part 7 having a bore 37 which has a bore pressure $P_B$ and which has been mounted as part of the well tubular metal structure 3 inserted into the borehole 5. The annular barrier 1 comprises an expandable metal sleeve 8 surrounding the tubular metal part 7, and each end 9 of the expandable metal sleeve 8 is connected to the tubular metal part 7, providing an expandable space 10 between the expandable metal sleeve 8 and the tubular metal part 7. The annular barrier 1 further comprises a pressure-intensifying unit 20 through which fluid from the annulus 2 or fluid from the bore 37 having entered through the expansion opening 11 (shown in FIG. 6) is pressure-intensified before entering into the expandable space 10 to expand the expandable metal sleeve 8. Thus, the annular barrier 1 comprises the pressure-intensifying unit 20 for increasing the pressure of the fluid from the bore 37 or the annulus 2 before the fluid enters the expandable space 10. The annular barrier 1 further comprises an activation chamber 80 having a chamber pressure $P_C$ and being fluidly connected to a second opening 36 of the pressure-intensifying unit 20 in order to create a pressure difference between the bore pressure/annulus pressure and the chamber pressure for activating the pressure-intensifying unit 20 to increase the pressure of the fluid. Thus, the chamber pressure $P_C$ is substantially lower than the bore pressure $P_B$, or the chamber pressure $P_C$ is substantially higher than the bore pressure $P_B$ so that a pressure difference is created therebetween.

By having the activation chamber 80 with lower pressure or higher pressure than the annulus pressure/bore pressure connected to the pressure-intensifying unit 20, the annular barrier 1 can be expanded even though the well tubular metal structure 3 has other openings such as screens, perforations, etc., and without having an opening in the tubular metal part 7 which needs to close after the expansion. The activation chamber creates a pressure difference to operate the pressure-intensifying unit. The pressure-intensifying unit has a high-pressure side and a low-pressure side. If the activation chamber is to provide the low pressure for the pressure-intensifying unit to function, the activation chamber is connected to the low-pressure side of the pressure-intensifying unit, and if the activation chamber is to provide the high pressure for the pressure-intensifying unit to function, the activation chamber is connected to the high-pressure side of the pressure-intensifying unit. Thus, the annular barrier can be expanded independently on the annulus pressure, and if the well tubular metal structure is perforated. The annular barrier 1 is thus automatically expanded, meaning that no additional pressure force than the bore pressure has to be applied, which is not possible in well tubular metal structures having screens, perforations or similar openings.

By having the activation chamber 80 with lower pressure, i.e. lower than the bore pressure or annulus pressure, or higher pressure, i.e. higher than the bore pressure or the annulus pressure, connected to the pressure-intensifying unit 20, the annular barrier 1 is also thus automatically expanded, meaning that no additional pressure force has to be applied, but the annular barrier 1 has an expansion opening in the tubular metal part 7.

When the well tubular metal structure 3 is perforated or has similar openings, the bore pressure and the annulus pressure are the same. But if the well tubular metal structure 3 does not have such openings, the pressure-intensifying unit 20 may be fluidly connected to either the bore pressure or the annulus pressure, whichever is the highest or the most appropriate in relation to the design of the pressure-intensifying unit 20 and the annular barrier 1.

Thus, the activation chamber 80 may be a low-pressure chamber. The activation chamber 80 is closed at surface, either during the manufacturing of the annular barrier or during the mounting of the annular barrier 1 on the well tubular metal structure 3 so that the chamber pressure is approximately 1 Atm, such as 101325 Pa, or 1,01325 Bar. The chamber pressure is at least 5 times lower than the annulus pressure or the bore pressure, preferably at least 8 times lower than the annulus pressure or the bore pressure, and more preferably at least 10 times lower than the annulus pressure or the bore pressure. The activation chamber 80 has a chamber volume which is at least 5% higher that the expandable space in the expanded condition of the annular barrier 1.

The activation chamber 80 may be a high-pressure chamber so that the chamber pressure is substantially higher than the annulus pressure or the bore pressure. The activation chamber 80 is pressurised at surface, either during the manufacturing of the annular barrier 1 or during the mounting of the annular barrier 1 on the well tubular metal structure 3 so that the chamber pressure is approximately at least 1,000 PSI, i.e. 6.8 GPa, higher than the annulus pressure or the bore pressure, preferably at least 2,000 PSI, i.e. 13.7 GPa, higher than the annulus pressure or the bore pressure, and more preferably at least 3,000 PSI, i.e. 20.6 GPa, higher than the annulus pressure or the bore pressure. The activation chamber 80 acting as a high-pressure chamber is pressurised with nitrogen or similar gas. The activation chamber 80 pressurised with nitrogen or similar gas has a substantially larger volume than needed to expand the expandable metal sleeve 8. The chamber pressure is at least 5 times higher than the annulus pressure or the bore pressure, preferably at least 8 times higher than the annulus pressure or the bore pressure, and more preferably at least 10 times higher than the annulus pressure or the bore pressure. The activation chamber 80 has a chamber volume which is at least 5% higher that the expandable space 10 in the expanded condition of the annular barrier 1. The activation chamber 80 comprises a chamber piston (not shown) dividing the activation chamber 80 in a first chamber part and a second chamber part. The first chamber part is pressurised at surface, and the second chamber part is in fluid communication with the bore 37 or the annulus 2 so that the first chamber part is pressurised even further as the annular barrier 1 is run into the well due to the higher pressure downhole than at surface.

After the annular barrier 1 has been run in hole, the annular barrier 1 is filled with fluid from the annulus 2 or the bore 37, and then the pressure-intensifying unit 20 is activated so that the low pressure or the high pressure from the activation chamber 80 operates the pressure-intensifying unit 20 to increase the pressure of the fluid before entering the expandable space 10, and thus the expandable metal sleeve 8 of the annular barrier 1 is expanded. The pressure-intensifying unit 20 ejects a certain amount of fluid into the expandable space 10 at a time, and once the amount of fluid has been ejected, the chamber pressure reactivates the pressure-intensifying unit 20 to be able to eject a new amount of fluid into the expandable space 10. When reactivating the pressure-intensifying unit 20, the activation chamber 80 may receive a small amount of fluid in order for the pressure-intensifying unit 20 to be recharged. Thus, the volume of the activation chamber 80 is higher than the volume of the fluid needed to expand the expandable metal sleeve 8 of the annular barrier 1.

In this way, an improved annular barrier is provided which is expandable without the need for pressurising or intervening the well tubular metal structure. The annular barrier 1 may comprise an expansion opening 11 in the tubular metal part 7 as shown in FIG. 6. When having an expansion opening 11, the second opening 36 can be fluidly connected to the bore 37 and/or the annulus 2.

In FIG. 2A, the pressure-intensifying unit 20 is shown having a first bore 21 and a piston unit 22. The first bore 21 has a first bore part 23 with a first inner diameter $ID_1$ and with a first bore end part 81. The first bore 21 also has a second bore part 24 with a second inner diameter $ID_2$ and with a second bore end part 82. The piston unit 22 has a first piston 25 with a first outer diameter $OD_1$ corresponding to the first inner diameter $ID_1$ and a second piston 26 with a second outer diameter $OD_2$ corresponding to the second inner diameter $ID_2$. The second piston 26 is connected to the first piston 25 by means of a connecting rod 27, which connecting rod 27 has a smaller outer diameter than the second piston 26. The first outer diameter $OD_1$ is smaller than the second outer diameter $OD_2$. The piston unit 22 moves between a first position in which the first piston 25 is closer to the first bore end part 81 than the second bore part 24 and a second position in which the first piston 25 is closer to the second bore part 24 than the first bore end part 81. The first bore part 23 has a first opening 31 in fluid communication with the expansion opening 11 through a first fluid channel 41, and a first non-return valve 28 is arranged in the first fluid channel 41 allowing fluid to enter the first opening 31. The second bore part 24 has a second opening 36, and the second opening 36 is closer to the first bore part 23 than the second bore end part 82. The first bore part 23 has a third opening 33 in fluid communication with the expandable space 10 through a second non-return valve 29. The second bore part 24 has a fourth opening 34 for the entry of fluid in order to allow the first piston 25 to move in a first direction, ejecting fluid through the third opening 33 and into the expandable space 10, and for the exit of fluid in order to allow the first piston 25 to move in a second direction opposite the first direction. The pressure-intensifying unit 20 further comprises a sequence piston 30 having a first sequence position in which the sequence piston 30 allows fluid communication between the second opening 36 and the fourth opening 34 and a second sequence position in which the sequence piston 30 allows fluid communication between the second opening 36 and the fourth opening 34 in order to move the piston unit 22 in the first direction. The first piston 25 has a front face facing the first bore end part 81.

When the activation chamber provides low pressure to create the pressure difference to activate expansion of the annular barrier, the activation chamber is fluidly connected to the openings of the pressure-intensifying unit 20 in connection with the annulus, i.e. the second opening 36 in FIGS. 2A, 2B, 3, and in FIGS. 4A-4F, the activation chamber is also fluidly connected to the fourth chamber opening 67 and the aperture 57. Hereby, the activation chamber is connected to the low-pressure side of the pressure-intensifying unit 20 to create the pressure difference between the low pressure in the activation chamber and the higher pressure in the bore. The bore may be fluidly connected to the annulus as mentioned earlier.

When the activation chamber provides high pressure to create the pressure difference to activate expansion of the annular barrier, the activation chamber is fluidly connected to aperture 52 of the pressure-intensifying unit 20 in FIGS. 2A, 2B, 3, and in FIGS. 4A-4F. Thus in this embodiment, the aperture 52 is the second opening of the pressure-intensifying unit in order to create a pressure difference. Hereby, the activation chamber is connected to the high-pressure side of the pressure-intensifying unit 20 to create the pressure difference between the high pressure in the activation chamber and the lower pressure in the bore or annulus.

In the first position, as shown in FIG. 2A, most of the fluid in the first bore part 23 in front of the first piston 25 has entered the expandable space 10, and in the second position the first bore part 23 is filled with fluid in front of the first piston. The low pressure in the activation chamber 80 is used to retract the piston unit 22 so that the first bore part 23 in front of the first piston 25 is re-filled with fluid from the annulus 2 or the bore 37 (shown in FIG. 1). As the piston unit 22 is retracted, the activation chamber 80 receives the fluid on the back of the first piston 25.

In FIG. 6, the annular barrier 1 further comprises a shear element valve block 130 which is fluidly connecting and disconnecting the pressure-intensifying unit 20 with the expandable space 10. The shear element valve block 130 is arranged for blocking the fluid communication to the expandable space after the expansion of the annular barrier is finished.

As shown in FIG. 2A, the second opening 36 is blocked by a shear disc 83 for closing the activation chamber 80 while the annular barrier 1 is run in hole. In order to ensure that the shear disc 83 does not break prematurely, the shear disc 83 is based on absolute pressure.

In FIG. 6, the second opening 36 (shown in FIG. 2A) is blocked by a mechanical connection 84 for closing the activation chamber 80 while the annular barrier 1 is run in hole. The mechanical connection 84 is activated to open by means of a tool run into the well tubular metal structure 3. Thus, the fluid communication between the second opening 36 and the annulus 2 or the bore 37 is closed by the mechanical connection 84, such as a sleeve or a valve assembly having a breakable pin, and the mechanical connection 84 is activated to open by means of a timer or a tool run into the well tubular metal structure 3.

In FIG. 2A, the first outer diameter $OD_1$ is smaller than the second outer diameter $OD_2$, as a result of which the fluid having entered through the expansion opening 11 is pressure-intensified before entering the expandable space 10 to expand the expandable metal sleeve 8 of the annular barrier 1 (shown in FIG. 1) to obtain a higher pressure than the pressure of the fluid entering the expansion opening 11 in the tubular metal part 7 (shown in FIG. 1) due to the diameter difference between the first piston 25 and the second piston 26. The first bore part 23 has the first opening 31 in fluid connection with the expansion opening 11 through the first fluid channel 41, and the first non-return valve 28 is arranged in the first fluid channel 41, allowing fluid to enter the first opening 31. The first bore 21 has a sixth opening 32 fluidly connected with a part of the first fluid channel 41 upstream of the first non-return valve 28. The first bore part 23 has the third opening 33 in fluid communication with the expandable space 10 through the second non-return valve 29. The second bore part 24 has the fourth opening 34 for the entry of fluid in order to allow the first piston 25 to move in a first direction, ejecting fluid through the third opening 33 and into the expandable space 10, and for the exit of fluid in order to allow the first piston 25 to move in a second direction opposite the first direction. The second bore part 24 has a fifth opening 35 in fluid communication with the fourth opening 34 through a second fluid channel 42 for allowing fluid to pass from one side of the second piston 26 to the other side of the second piston 26 when the second piston 26 moves back and forth.

Thus, the first piston 25 moves between the sixth opening 32 and the third opening 33, and the second piston 26 moves between the fourth opening 34 and the fifth opening 35 so that fluid flows between the fourth opening 34 and the fifth opening 35 via the second fluid channel 42. The second fluid channel 42 functions as a kind of bypass channel so that the second piston 26 is able to move as the fluid is in liquid form downhole and thus more or less incompressible and needs to be displaced elsewhere in order to be able to move the second piston 26.

The pressure-intensifying unit 20 further comprises the sequence piston 30 surrounding the connecting rod 27. In FIG. 2A, the sequence piston 30 has a first sequence position in which the sequence piston 30 prevents fluid communication between the sixth opening 32 and the fifth opening 35 so that the fluid from within the tubular metal part 7 passes through the expansion opening 11 and into the first fluid channel 41 through the first non-return valve 28 and in through the first opening 31, and presses onto the first piston 25 to move the first piston 25 in a second direction towards the second bore part 24. In FIG. 2B, the sequence piston 30 has a second sequence position in which the sequence piston 30 allows fluid communication between the sixth opening 32 and the fifth opening 35 in order to move the piston unit 22 in the first direction and press the fluid in the first bore part 23 in through the third opening 33 and the second non-return valve 29, and into the expandable space 10 to expand the expandable metal sleeve 8 of the annular barrier 1. In the second sequence position, the sequence piston 30 straddles the sixth opening 32 and the fifth opening 35. In the first sequence position, the sequence piston 30 isolates the sixth opening 32 so that all fluid through the expansion opening 11 is forced to flow in through the first fluid channel 41 and the first non-return valve 28 and into the first bore part 23.

As shown in FIG. 2A, the sequence piston 30 has a first piston part 43 and a second piston part 44, and an intermediate piston part 45 connecting the first piston part 43 and the second piston part 44; the intermediate piston part 45 has a smaller outer diameter than that of the first piston part 43 and the second piston part 44 so as to fluidly connect the sixth opening 32 and the fifth opening 35 when the sequence piston 30 is in the second sequence position, and so that the first piston part 43 is positioned on one side of the fifth opening 35, and the intermediate piston part 45 straddles the sixth opening 32 and the fifth opening 35, and the second piston part 44 is arranged on the other side of the sixth opening 32. Thus, the intermediate piston part 45 has a smaller outer diameter than that of the first piston part 43 and the second piston part 44, providing an annular cavity 47 between the first bore 21 and the sequence piston 30 to enable fluid passage between the sixth opening 32 and the fifth opening 35.

The sequence piston 30 has a through-bore 46 having a bore diameter $ID_3$ being larger than the outer diameter of the connecting rod 27 so that fluid is allowed to pass between the connecting rod 27 and the sequence piston 30 along the bore diameter $ID_B$. The outer diameter of the first piston part 43 and the second piston part 44 of the sequence piston 30 corresponds to the inner diameter of the second bore part 24. However, in another embodiment the sequence piston 30 is arranged in the first bore part 23.

As shown in FIGS. 2A and 2B, the first bore 21 comprises the second opening 36 arranged between the fifth opening 35 and the third opening 33 and is in fluid communication with an activation chamber 80 (shown in FIG. 1). In that way, the chamber pressure is used as an accumulator.

In FIG. 3, the first piston part 43 of the sequence piston 30 is provided with at least two sealing elements 72 arranged at a distance between them that is larger than the diameter of the fifth opening 35. In this way, the second piston part 44 of the sequence piston 30 is sealing off the fifth opening 35 until the sequence piston 30 straddles the fifth opening 35 and the second opening 36, and there is no risk of stranding opposite the fifth opening 35, where fluid may flow from the second opening 36 past the first piston part 43 and directly into the second bore part 24 without being forced through the second fluid channel 42, as shown in FIG. 4C.

As can be seen in FIG. 2A, the outer diameter of the connecting rod 27 is smaller than the first outer diameter $OD_1$ and the second outer diameter $OD_2$. In FIG. 3, the outer diameter of the connecting rod 27 is smaller than the first outer diameter $OD_1$ and substantially equal to the second outer diameter $OD_2$. In FIG. 3, the sequence piston 30 has an internal key 73 moving in a groove 74 of the connecting rod 27 for bringing the sequence piston 30 to move from the first sequence position to the second sequence position. The movement of the sequence piston 30 from the second sequence position to the first sequence position is performed by the second piston 26.

In order to increase the fluid pressure of the fluid entering the expansion opening 11 before being ejected into the expandable space 10, the second outer diameter $OD_2$ is more than 1.2 times larger than the first outer diameter $OD_1$, preferably more than 1.5 times larger than the first outer diameter, more preferably more than 2 times larger than the first outer diameter, and even more preferably more than 2.5 times larger than the first outer diameter.

The pressure intensification factor of the pressure-intensifying unit 20 is given by the piston area difference between the first and the second piston 25, 26, and thus the difference between the second outer diameter $OD_2$ and the first outer diameter $OD_1$ is $(OD_2/OD_1)^2$.

In FIGS. 4A-4F, the pressure-intensifying unit 20 further comprises a second bore 51 having a first aperture 52 fluidly connected with the expansion opening 11 and a second aperture 53 fluidly connected with the first fluid channel 41. In the second bore 51, a third piston 54 and a fourth piston 55 are connected by means of a second connecting rod 56. In a deployment position of the annular barrier 1, i.e. when the annular barrier 1 is run in the hole and mounted as part of the well tubular metal structure 3, the third piston 54 and the fourth piston 55 are arranged on either side of the second aperture 53, preventing fluid from entering the first fluid channel 41 and thus the expandable space 10. In this way, the expandable metal sleeve 8 of the annular barrier 1 is not expanded prematurely, and the annular barrier 1 is not set in an unintended position in the borehole 5 preventing further movement of the well tubular metal structure 3 down the hole. The second bore 51 is arranged in parallel to the first bore 21, but could be arranged in any angle to the first bore 21.

The third piston 54 and the fourth piston 55 are prevented from moving in the deployment position by a shear pin 59 until the expansion operation starts and a pressure builds up inside the tubular metal part 7; when a predetermined pressure is obtained in the well tubular metal structure 3 acting on the third piston 54, the shear pin 59 is sheared, and the third piston 54 and the fourth piston 55 move, providing fluid communication between the first aperture 52 and the second aperture 53 as well as fluid communication to the first bore 21. In another embodiment, the shear pin function is arranged in an additional shear pin valve block 130 (shear element valve block 130 shown in FIGS. 5A and 5B) in fluid communication with the second aperture 53 and arranged fluidly between the expansion opening 11 and the second aperture 53. The shear pin 59 could also be replaced by a shear disc arranged in the fluid communication between the expansion opening 11 and the second aperture 53.

In order to prevent the expandable metal sleeve 8 from being pressed inwards due to a higher pressure down the well than in the expandable space 10 as the annular barrier 1 is deployed, the second bore 51 further comprises a third aperture 57 in fluid communication with the annulus 2 and a fourth aperture 58 in fluid communication with the expandable space 10, as shown in FIG. 4A. In the deployment position of FIG. 4A, the third piston 54 and the fourth piston 55 are both arranged on one side of the third aperture 57 and the fourth aperture 58, providing fluid communication between the third and fourth apertures 57, 58. Thus, the role of the third piston 54 and the fourth piston 55 is also to ensure that there is no trapped pressure in the annular barrier 1, i.e. in the expandable space 10, during deployment due to the second non-return valve 29. The expandable space 10 underneath the expandable metal sleeve 8 will therefore be pressure-compensated with the annulus pressure. Thus, the third aperture 57 and the fourth aperture 58 are in fluid communication on the "backside" of the third piston 54 and the fourth piston 55 as the second aperture 53 is arranged on the "frontside" of the third piston 54 and the fourth piston 55, while the third piston 54 and the fourth piston 55 are arranged on either side of the second aperture 53.

In FIGS. 4A-4F, the pressure-intensifying unit 20 further comprises a first chamber 61 having a first chamber opening 68 fluidly connected to the second bore part 24 for accumulating fluid from the second bore part 24. Thus, the first chamber 61 is a kind of accumulating chamber or accumulator. The first chamber 61 has a second chamber opening 69 fluidly connected with the first fluid channel 41, and the first chamber 61 comprises a first chamber piston 62 being spring-loaded by means of a first spring 63 so that the first chamber piston 62 is forced towards the first chamber opening 68. The first chamber piston 62 is allowed to move between the first chamber opening 68 and the second chamber opening 69. By having a first chamber 61 with a spring-loaded first chamber piston 62, the first chamber 61 is able to accumulate fluid in the second bore part 24 which cannot bypass the second piston 26 in the second fluid channel 42 when the second piston 26 moves in the second direction. This is primarily the situation which may occur towards the end of the movement in the second direction as shown in FIG. 4C, where the first piston 25 moves the sequence piston 30, blocking the fifth opening 35 even though the second piston 26 has not moved entirely to the end (as shown in FIG. 4D), and the remaining fluid can then enter the first chamber 61. In this way, no fluid/liquid is trapped preventing the second piston 26 from moving to the end, and the first piston 25 is not prevented from moving the sequence piston 30 to the second sequence position opening for fluid passage to push the piston unit 22 in the first direction. The first chamber is thus a safety precaution to ensure that the sequence piston 30 is able to move to the second sequence position. The first chamber piston 62 is preloaded by the pressure in the expansion fluid pressing through the second chamber opening 69 and on the first chamber piston 62.

The pressure-intensifying unit 20 further comprises a second chamber 64 fluidly connected to the second bore part 24 via the first chamber 61. The second chamber 64 comprises a third chamber opening 70 in fluid communication with the first chamber 61. The second chamber comprises a fourth chamber opening 67 fluidly connected with the annulus 2, and the second chamber comprises a second chamber piston 65 being spring-loaded by means of a second spring 66 so that the second chamber piston is forced towards the fluid connection to the second bore part 24, i.e. towards the first chamber opening 68, and forced to move between the third chamber opening 70 and the fourth chamber opening 67. By having a second chamber 64 with a spring-loaded second chamber piston 65, the second chamber is able to provide pressurised fluid in the second bore part 24 to press the piston unit 22 fully to the second non-return valve 29 and push the sequence piston 30 to the first sequence position. The second chamber piston 65 experiences annulus pressure from the fourth chamber opening 67 and expansion pressure (pressure from the tubular metal part 7 through the expansion opening 11) through the third chamber opening 70, and when the sequence piston 30 is opposite the fifth opening 35 as shown in FIG. 4E, the fluid may be prevented from entering the second fluid channel 42 and from pressing on the second piston 26 to move the piston unit 22 further towards the second non-return valve 29. The sequence piston 30 may then not be fully moved to the first sequence position, and then the pressure difference across the second chamber piston 65 will force the second chamber piston 65 to move, increasing the pressure in the second bore part 24 in fluid communication with the second chamber 64 through the first chamber opening 68. In this way, the movement of the sequence piston 30 from the position shown in FIG. 4E to the position shown in FIG. 4F is completed, i.e. the first sequence position is ensured so that the movement cycle of the pressure-intensifying unit 20 is completed.

In order to expand the expandable metal sleeve 8 of the annular barrier 1, the piston unit 22 and thus the first piston 25 and the second piston 26 have to move back and forth 500-5000 times, and the seals of these pistons are therefore preferably metal seals, ceramic seals or similar seals able to withstand such load.

In FIGS. 4A-4F, when the activation chamber 80 provides the high pressure, the second opening is the first aperture 52 if the activation chamber is functioning as the high-pressure chamber, and when the activation chamber 80 provides the low pressure, the second opening is the second opening 36 in FIGS. 4A-4F.

FIGS. 5A and 5B disclose a shear element valve block 130 having a first block opening 116 in fluid communication with the expansion opening 11 and a block piston 121 moving in a bore 120 and having a through-bore 122 in which a shear disc 124 is arranged. Opening 137 may be connected to the annulus. A second block opening 117 is in fluid communication with the first fluid channel 41 in FIGS. 2A-4F so that, in the first block position shown in FIG. 5A, fluid from the expansion opening 11 is let into the pressure-intensifying unit 20, and in a second block position, as shown in FIG. 5B, the shear element valve block 130 prevents the fluid from entering since the fluid communication between the first block opening 116 and the second block opening 117 is blocked.

FIGS. 7A-7D show a cross-sectional view of a pressure-intensifying unit in four different positions. FIG. 7A shows the pressure-intensifying unit 20 in the first position. The pressure-intensifying unit 20 is shown having a first bore 21 and a first piston unit 22. The first bore 21 has a first bore part 23 with a first inner diameter. The first bore 21 also has a second bore part 24 with a second inner diameter. The piston unit 22 has a first piston 25 with a first outer diameter corresponding to the first inner diameter and a second piston 26 with a second outer diameter corresponding to the second inner diameter. The second outer diameter is greater than the first outer diameter. The pressure-intensifying unit 20 further comprises a second bore 51 having a first aperture 52 fluidly connected with the expansion opening 11 or the activation chamber 80 and a second aperture 53 fluidly connected with the first bore 21. In the second bore 51, a second piston unit 50 comprises a third piston 54 and a fourth piston 55 being connected by means of a second connecting rod 56. The pressure-intensifying unit 20 further comprises a shaft 71 activated to abut the second piston unit 50 by a spring 72B.

The pressure-intensifying unit 20 has a low-pressure side being connected via opening 36 and aperture 67*b* to annulus 2 or the activation chamber. The pressure-intensifying unit 20 also has a high-pressure side being connected via opening 52 to the bore 37 through the expansion opening 11 or the activation chamber. If the activation chamber 80 functions as providing high pressure, it is connected to the high-pressure side and if the activation chamber 80 functions as providing low pressure, it is connected to the low-pressure side. The pressure from the bore through opening 33 enters a second non-return valve 29, e.g. a check valve, and via channel 75 pushes on the first piston 25, and it moves to a second position shown in FIG. 7B, and the bore pressure reaches the second bore 51 through the second aperture 53, and the shaft 71 becomes pressure-balanced, and the spring 72B pushes the second piston unit 50 backwards to the third position as shown in FIG. 7C. In this position, the second piston unit 50 connects the bore pressure to the first bore 21 via channel 74B and the bore pressure pushes the first piston unit back to a fourth position shown in FIG. 7D, and the fluid in front of the first unit piston is forced into the expandable space 10 through first non-return valve 28, e.g. a check valve. When the first piston unit reaches its end stroke, the low pressure i.e. annulus pressure or activation chamber is fluidly connected to the end of the second piston unit 50 through channel/second aperture 53 and bore pressure on the other side moving the second piston unit 50 and actuates the shaft 71 compressing the spring 72B to the first position connecting the front of the first piston unit 22 to the low pressure side again for another cycle.

In FIGS. 7A-7D, the number 80 for "activation chamber" is noted both at the high-pressure side at number 11 and at the low-pressure side at number 36, where it is apparent that the activation chamber is not connected to both but only one of the two options at a time. So in other words "36, 80" indicates that the activation chamber may be connected to this opening being the second opening when the activation chamber is to provide the low pressure in order to make the pressure intensifier function, and in the same way "11, 80" indicates that the activation chamber may be connected to this opening 52 being the second opening and thus fluidly connected to either the bore 37 having entered through the expansion opening 11 or the activation chamber 80 when the activation chamber is to provide the high pressure in order to make the pressure intensifier function.

The annular barrier 1 may be part of a downhole system 100 as shown in FIG. 1, where the downhole system comprises a well tubular metal structure 3 and the above-mentioned annular barrier, and where the tubular metal part 7 is mounted as part of the well tubular metal structure 3. The downhole system 100 may have a plurality of annular barriers even though not shown.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. An annular barrier to be expanded in an annulus having an annulus pressure between a well tubular metal structure and an inside wall of a borehole downhole for providing zone isolation between a first zone and a second zone of the borehole, comprising a tubular metal part for mounting as part of the well tubular metal structure, the tubular metal part having a bore with a bore pressure, an expandable metal sleeve surrounding the tubular metal part, each end of the expandable metal sleeve being connected with the tubular metal part, and an expandable space between the expandable metal sleeve and the tubular metal part, wherein the annular barrier further comprises a pressure-intensifying unit having a first opening in fluid communication with the annulus or the bore for increasing the pressure of the fluid from the annulus or the bore before the fluid enters the expandable space, the annular barrier further comprising an activation chamber having a chamber pressure and being fluidly connected to a second opening of the pressure-intensifying unit, the activation chamber being configured to create a pressure difference between the annulus pressure/the bore pressure and the chamber pressure for activating the pressure-intensifying unit to increase the pressure of the fluid, the chamber pressure being lower than the annulus pressure or the bore pressure, or the chamber pressure being higher than the annulus pressure or the bore pressure.

2. An annular barrier according to claim 1, wherein the pressure-intensifying unit has a first bore and a piston unit, the first bore having a first bore part with a first inner diameter and having a first bore end part and a second bore part with a second inner diameter and having a second bore end part, the piston unit having a first piston with a first outer diameter corresponding to the first inner diameter and a second piston with a second outer diameter corresponding to the second inner diameter, and the second piston being connected to the first piston by means of a connecting rod, which connecting rod has a smaller outer diameter than the second piston, the first outer diameter being smaller than the second outer diameter, the first bore part having the first opening, and the second bore part having the second opening.

3. An annular barrier according to claim 1, wherein the piston unit moves between a first position in which the first piston is closer to the first bore end part than the second bore part and a second position in which the first piston is closer to the second bore part than the first bore end part.

4. An annular barrier according to claim 1, wherein the first opening is in fluid communication with the annulus through a first fluid channel, a first non-return valve being arranged in the first fluid channel allowing fluid to enter the first opening.

5. An annular barrier according to claim 1, wherein, the second bore part has the second opening closer to the first bore part than the second bore end part.

6. An annular barrier according to claim 1, wherein the first bore part has a third opening in fluid communication with the expandable space through a second non-return valve.

7. An annular barrier according to claim 6, wherein the second bore part has a fourth opening for the entry of fluid in order to allow the first piston to move in a first direction, ejecting fluid through the third opening and into the expandable space, and for the exit of fluid in order to allow the first piston to move in a second direction opposite the first direction.

8. An annular barrier according to claim 1, wherein, the pressure intensifier further comprises a sequence piston having a first sequence position in which the sequence piston allows fluid communication between the second opening and the fourth opening and a second sequence position in which the sequence piston allows fluid communication between the second opening and the fourth opening in order to move the piston unit in the first direction.

9. An annular barrier according to claim 1, wherein the activation chamber is filled with pressurised nitrogen or similar gas.

10. An annular barrier according to claim 1, wherein the activation chamber is a low-pressure chamber.

11. An annular barrier according to claim 1, wherein the activation chamber is closed at surface so that the chamber pressure is approximately 1 Atm.

12. An annular barrier according to claim 1, wherein the chamber pressure is at least 5 times lower than the annulus pressure or the bore pressure.

13. An annular barrier according to claim 1, wherein the activation chamber has a chamber volume which is at least 5% higher that the expandable space in the expanded condition of the annular barrier.

14. A downhole system comprising a well tubular metal structure and at least one annular barrier according to claim 1 where the tubular metal part is mounted as part of the well tubular metal structure.

15. An annular barrier according to claim 1, wherein the activation chamber is formed externally of the pressure-intensifying unit.

16. An annular barrier according to claim 1, wherein the pressure-intensifying unit is positioned between the activation chamber and the expandable metal sleeve.

17. An annular barrier according to claim 1, wherein the activation chamber has a volume that is greater than a volume of the fluid needed to expand the expandable metal sleeve.

18. An annular barrier according to claim 1, wherein the volume of the activation chamber is separate from and fluidly connectable a volume of the pressure-intensifying unit.

19. An annular barrier according to claim 1, wherein the pressure-intensifying unit is configured to be selectively connected between a high pressure side and a low pressure side of the activation chamber.

* * * * *